United States Patent [19]

Deschler

[11] 4,068,326

[45] Jan. 17, 1978

[54] INFLATABLE BATHTUB

[76] Inventor: Kathleen E. Deschler, 18111 Dorchester Circle, Villa Park, Calif. 92677

[21] Appl. No.: 585,080

[22] Filed: June 9, 1975

[51] Int. Cl.[2] ..... A47K 3/06; A47K 3/062; A47K 3/07; A47K 3/23

[52] U.S. Cl. ..... 4/150; 4/172; 4/172.12; 4/177 CW; 4/145

[58] Field of Search ..... 4/177, 177 IW, 172.12, 4/172.19, 172, 162

[56] References Cited

U.S. PATENT DOCUMENTS

| | | | |
|---|---|---|---|
| 266,531 | 10/1882 | Rosenfield | 4/150 |
| 552,839 | 1/1896 | Humphrey | 4/150 |
| 1,023,590 | 4/1912 | Parry | 4/145 UX |
| 1,203,579 | 11/1916 | Callon | 4/150 |
| 1,677,160 | 7/1928 | Woolfenden | 4/150 |
| 2,100,186 | 11/1937 | Hagopian | 4/150 |
| 2,471,302 | 5/1949 | Boward | 4/177 IW |
| 3,375,534 | 4/1968 | Vieceli | 4/162 |
| 3,611,448 | 10/1971 | Dudley | 4/162 |
| 3,681,789 | 8/1972 | Bott | 4/177 IW |
| 3,800,336 | 4/1974 | Hoxeng | 4/177 |
| 3,803,642 | 4/1974 | Erling | 4/177 |
| 3,837,014 | 9/1974 | Sugiyama | 4/162 |

*Primary Examiner*—Henry K. Artis
*Attorney, Agent, or Firm*—Gregory J. Nelson

[57] ABSTRACT

A bathtub which can be inflated about a bed-ridden patient with minimum inconvenience to the patient is disclosed. Inflatable tubular cells form the sidewalls which support an impermeable liner forming an enclosure. A cover extends between the sidewalls. Conduits for water supply and drainage communicate with the enclosure. The supply system includes a spray system to direct water against the prone patient. An independent water recirculation system and thermostatically controlled heater may also be incorporated.

4 Claims, 6 Drawing Figures

FIG-1
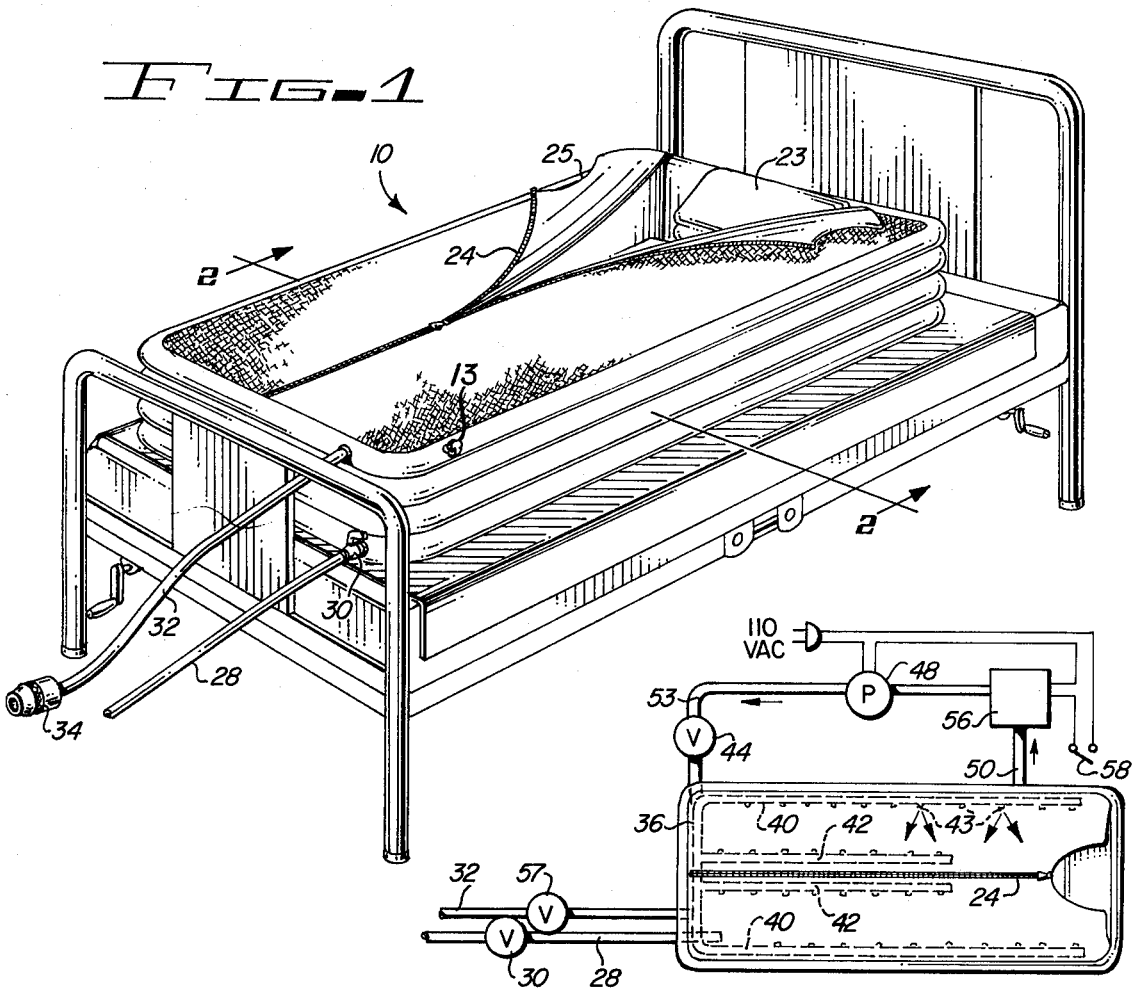
FIG-3
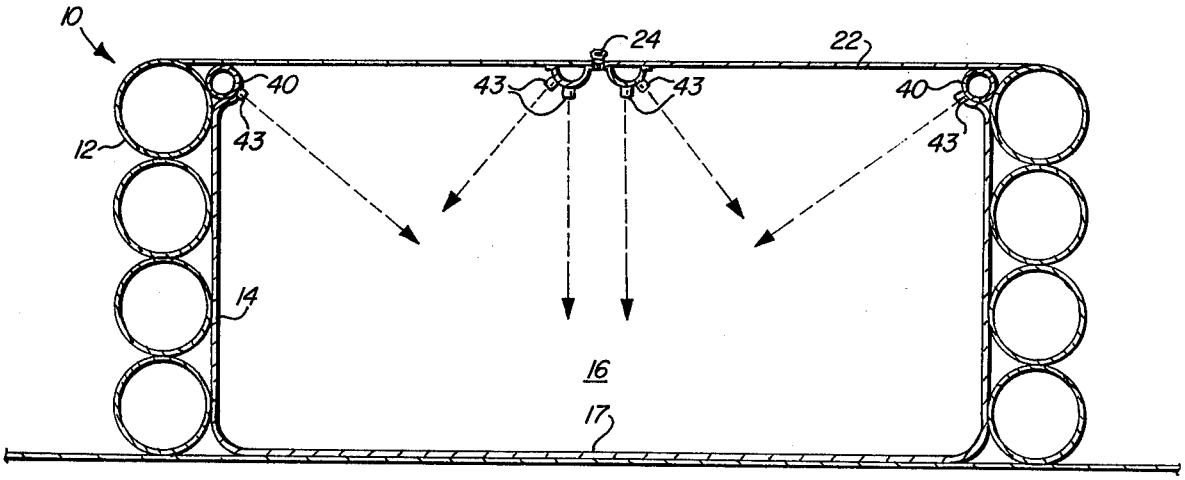
FIG-2

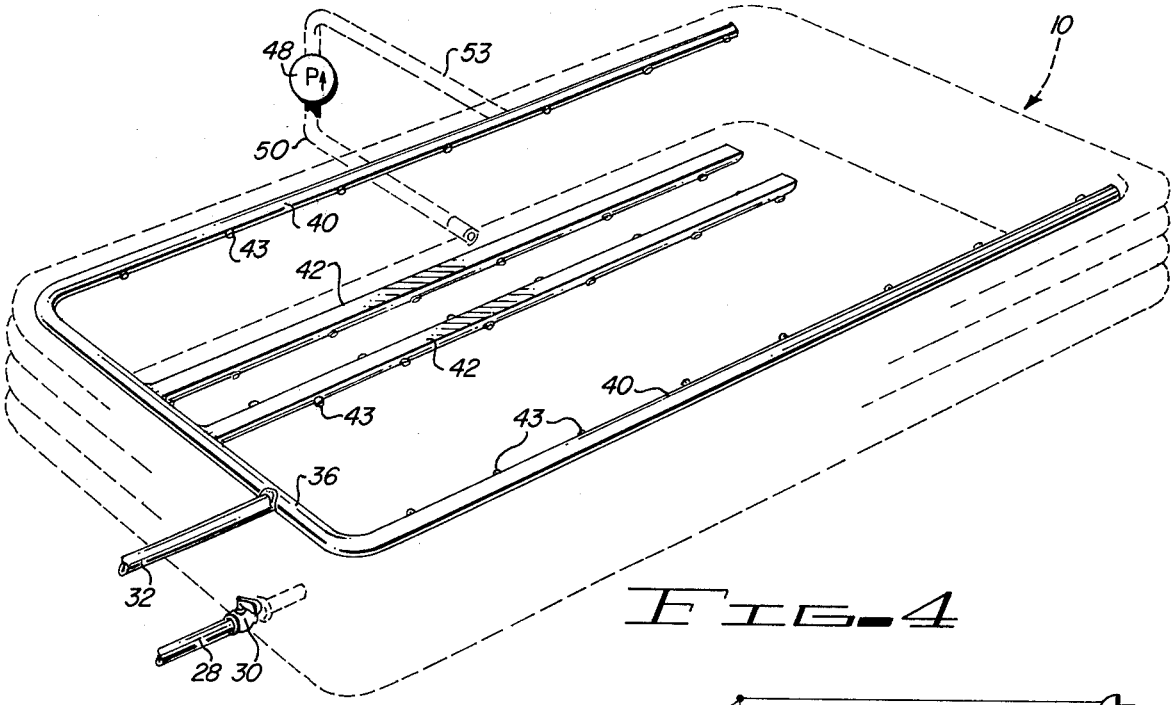
FIG-4
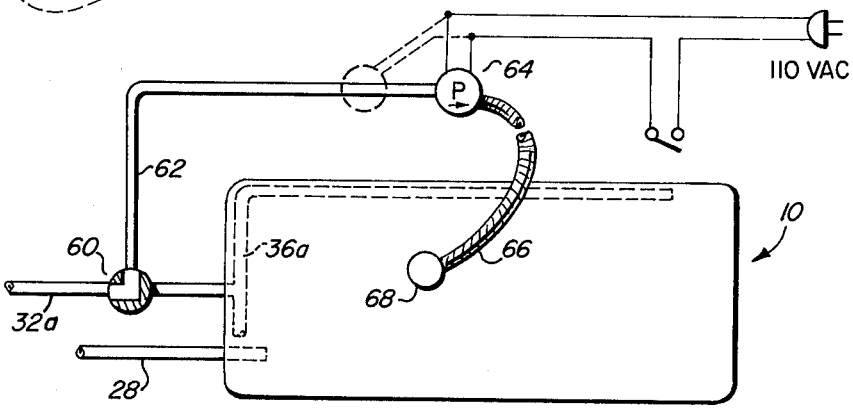
FIG-5
FIG-6
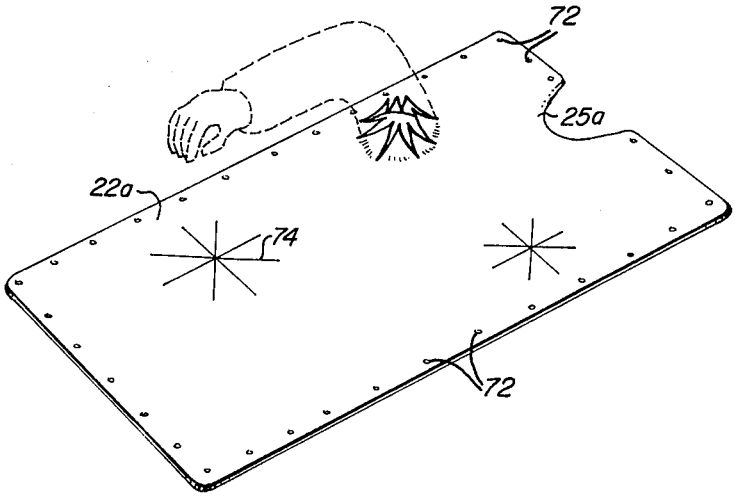

INFLATABLE BATHTUB

The present invention relates generally to a bathtub and more particularly relates to an improved bathtube which can be pneumatically inflated for immersion bathing a human body in a generally prone position.

It is often exceedingly difficult, if not impossible, for bed-ridden individuals to bathe themselves as they are unable to use conventional bathtubs and showers. Many of these individuals are non-ambulatory and cannot be moved. Further, conventional bathtubs and showers pose a serious safety problem to the invalid person. Therefore, it is often the practice of hospitals, convalescent homes and nursing homes to relay on localized cleansing procedures such as alcohol and sponge baths. These procedures are not particularly effective and may not result in the patient being thoroughly and hygienically bathed. Further, long periods of confinement in bed without thorough body cleansing can result in patients being troubled by bed scres. Rising medical costs have also resulted in more patients receiving long term nursing care in their homes. In this instance, as in the hospital, it is difficult for many convalescent patients to bathe themselves. Again, the patient must rely on localized cleansing such as sponge baths often administered by non-professionals and the problems caused by ineffective bathing procedures are more acute.

Since the bed-ridden patient is unable to utilize conventional bathing facilities, it has been suggested in prior art to provide inflatable bathtubs of various types. Generally, the inflatable bathtubs of the prior art comprise simply a tubular wall which is inflatable and forms the periphery of the tub. A heat sealable floor panel extends between the side panels. Generally the prior art bathtubs have been used primarily for infants and have not found wide acceptance for adult patients. The prior art inflatable tubs generally have no provision for filling and draining water. Because of this, it became a laborious and tedious job to manually fill the tubs with water. Another problem is that during the filling the water becomes cold and the patient is uncomfortable. Another serious problem with prior full size collapsible tubs, is the difficulty that patients have in entering into the tub. If the tub is supported on the patient's bed, it often becomes a difficult matter for the patient to maneuver himself into the tub. Further, splashing of water from this tubs of water results in web bed clothes and extensive clean-up is necessary after use.

Because of the general disadvantages of the prior art collapsible tubs, such tubs have never found wide acceptance. Briefly, the present invention provides a highly convenient pneumatically inflatable tub which is adapted to be supported on the patient's bed. The tub is formed from a plurality of inflatable tubular cells which support an interior tub linear forming an enclosure for receiving the patient. A removable or openable cover extends across the top of the enclosure between the sidewalls. Conduit connect with the tub enclosure for filling and draining the tub. The conduits for filling the tub can be attached to any conventional water faucet. A spray system connects with the inlet conduit through a common header so that the patient can be "showered" with a stream of water to effect thorough cleansing. The cover serves to contain the spray within the enclosure and prevent spillage. Another modification of the bathtub of the present invention incorporates a heater and recirculation system. The recirculation system reuses the water within the tub and introduces it through the spray system so that minimum water volume is required for bathing. In another embodiment the spray system includes a flexible hand-held shower member which can be used by the patient within the enclosure to effect localized cleansing and hydrotherapy.

The present invention and the manner in which the invention can be practiced will become more apparent from the detailed description when taken in conjunction with the accompanying drawings forming a part of the specification and in which like reference numerals designate like parts throughout the several views.

FIG. 1 is a perspective view of the inflatable bathtub of the present invention shown in an inflated condition position on a standard hospital bed;

FIG. 2 is a cross-sectional view taken along lines 2—2 of FIG. 1;

FIG. 3 is a schematic view illustrating the heater and recirculation system;

FIG. 4 is a perspective view of the tub with the cover removed showing the details of the spray and recirculation systems;

FIG. 5 is a schematic view illustrating the patient-operated shower head in conjunction with the recirculation system; and FIG. 6 illustrates another form of the cover panel especially adapted for use by patients having a limb confined in a cast.

Referring now to the drawings, particularly FIGS. 1, 2 and 4, the bathtub of the present invention is generally designated by the numeral 10. As seen in FIGS. 1 and 2, bathtub 10 is formed from a plurality of stacked inflatable tubular cells 12 which form the peripheral sidewalls of the tub. Tubular cells 12 are interconnected and are inflatable at conventional air valve 13. An interior liner 14 is continuous having a floor portion 17 and forms the enclosure 16 which receives the patient. The tubular cells 12 and liner 14 are formed of an impermeable material such as seamless polyethylene having approximately six-to-ten mil thickness. The tubular cells 12 and the linear can be easily fabricated and joined by conventional heat sealing techniques utilized in the plastics industry.

As seen in FIG. 2, in an inflated condition enclosure 16 is generally rectangular and is of a dimension to comfortably accommodate the prone body of the patient. Preferably the bathtub 10 is of a width permitting it to be accommodated on a conventional hospital bed, such as bed 20, adjacent the patient. This facilitates placing the patient in the bathtub as will be explained hereafter.

A horizontally extending top cover 22 extends between upper tubular cells 12. Cover 22 has cut-outs 25 to permit the patient's face and head portion to be elevated above the cover 22. A medially extending fastener 24, such as a zipper or gripper snaps permits access to the tub enclosure 16 through the cover 22. An inflatable pillow member 23 is provided at one end of enclosure 16 to receive the head and cervical portion of the patient to support the patient in a comfortable reclining position during use.

Drain conduit 28 communicates with the interior of the enclosure and is controlled by valve 30. Drain 28 can be extended and located at any convenient location such as a shower floor drain. Since the bathtub normally is supported on a bed, the contents of enclosure 16 will easily and rapidly drain by gravity through conduit 28. Water is supplied to the bathtub by means of supply conduit 32. The end of conduit 32 is provided with an adaptor 34 which can be connected to the conventional water faucet or to an appropriate threaded hose connection.

Conduit 34 connects to an interior spray system including a transverse header member 36 and longitudinally extending spray lines 40 and 42. Lines 40 extend along the longitudinal sidewalls. Spray lines 42 are preferably located along either side of medial fastener 24. Spray lines 40 and 42 similarly can be formed of flexible polyethylene or may be made of a more rapid material such as polyvinylchloride. Flexibility is desirable for convenience of storage and access to the tub enclosure. Spray lines 40 and 42 are equipped with directionally oriented openings 43 which may be simply in the form of perforations in the lines or may be in the form of adjustable nozzles. The spray nozzles 43 direct a fine spray of water onto the body of the patient so that cleansing is achieved both by partial immersion and by the "shower" effect of the spray.

In order to minimize the amount of water necessary for the patient to bathe, the bathtub of the present invention may incorporate an independent recirculation system. Referring to FIG. 3, a small recirculating pump 48 is provided having inlet line 50 communicating with the interior enclosure 16 near the bottom. The discharge line 53 of pump 48 connects with header 36 across valve 44. Valve 57 is interposed in supply line 32 to isolate the recirculation system when in use. Preferably, a small electric heater 56, which is thermostatically controlled, maintains recirculating the water at a predetermined temperature. The recirculation system and the heater are actuated by means of switch 58.

A more complete understanding of the present invention will be had from the following description of use. When the bathtub 10 is not in use, it can be stored in a deflated condition taking up very little space. When a patient confined to bed wishes to bathe, the tub 10 is moved to the patient's bed. The patient is permitted to remain on the bed and the tub 10 is unfolded on the bed longitudinally adjacent the patient. The patient is moved or rolls to a position lying face-up on floor 17 of the deflated tub. Tubular cells 12 are inflated through air valve 13. This can be readily accomplished by manually exhaling into valve 13 or by using an auxiliary air system. The inflation of the tub will cause cells 12 to expand and will in effect erect the enclosure 16 about the patient. This minimizes the amount of movement necessary on the part of the patient and is particularly advantageous in the case of patients who are unable to move themselves about. In this way, it is not necessary for the assistant to physically lift and move a non-ambulatory patient. Once inflation has been accomplished supply line 32 can be connected to a suitable water source at adaptor 34. Similarly, drain line 28 is placed at a suitable drain with valve 30 closed. Cover panel 22 is secured at fasteners 24. The patient is in a generally prone position with the patient's heat supported at pillow 23 and extending through the panel flaps 22 at openings 25. When water is admitted via supply line 32, it is distributed by heater 36 into longitudinally extending spray lines 40 and 42. The spray nozzles 43 direct a fine spray completely over the body of the patient. The water collects in the bottom of enclosure 16 to partially immerse the patient. This effects a thorough cleaning and allows the entire body of the patient to be washed. Once a predetermined volume of water has been admitted into the enclosure 16, the water supply can be turned off. Actually, the volume of water within the enclosure 16 does not have to completely immerse the body of the patient since washing is aided by the interior spray system.

If desired, a longer bathing period can be achieved by use of the auxiliary recirculation system which can be actuted by closing switch 58. Valve 57 is also closed. This energizes pump 48 which draws water from enclosure 16 through suction line 50. Recirculated water is discharged through line 53 and across valve 54 into the header 36 and to distribution lines 40 and 42. Heater 56 maintains the recirculating water at a predetermined constant temperature. The patient can be subjected to the washing spray as long as necessary. When bathing is completed, the recirculating pump 48 is turned off at switch 58. Valve 30 is opened and water drains from enclosure 16. During this time cover panel 22 serves to maintain a warm temperature within closure 16 so that the patient does not become chilled. When the water is entirely drained from the system, panel 22 is opened and the patient can be towel dried. The unit is deflated by opening air valve 13 permitting air within the cells 12 to be released. When the tub 10 is fully collapsed, the patient can be removed from the tub to the surface of the bed. Bathtub 10 is then folded into a relatively compact unit for convenient storage during periods of non-use.

From the foregoing it will be seen that the bathtub of the present invention is convenient and easy to use either in hospitals or for home care use. The tub permits the immobile bed-ridden patient to bathe and be subject to a cleansing spray for as long as the patient desires using only a small volume of water. An important feature of the invention is that it is not necessary for the patient to be moved from his bed during the bath and minimum patient movement is required. The tub, is effect, provides a combination immersion bath and shower which is healthful and is particularly beneficial to prevent and treat bed sores commonly associated with patients confined for long periods to beds.

FIG. 5 illustrates another embodiment of the present invention. In this embodiment, bathtub 10 is generally constructed as is previously described with reference to FIGS. 1 through 4. Inlet line 32*a* is provided with two-way valve 60 which can selectively direct flow into spray manifold 36*a* or alternately into by-pass line 62. By-pass 62 connects to the inlet of pump 64. Pump 64 boosts or increases the pressure of the water from the supply line 32*a*. A flexible hose 66 is connected to pump 64 and extends within the tub through an appropriate opening. The end of hose 66 carries a spray nozzle 68. This arangement permits the patient to move spray head 68 about within the tub enclosure to selectively direct water spray to a localized area of the patient's body. The localized high pressure spray emitted from spray head 68 is particularly adapted to hydrotherapeutic treatment.

FIG. 6 shows another form of the cover panel for the tub which is designated by the numeral 22*a*. Peripherally spaced fasteners 72 extend around panel 22*a*. Fastenes 72 are adapted to engage fasteners secured about upper surface of the tub sidewalls so that panel 22*a* can be snapped in place over the patient. Cut-away portion 25*a* accommodates the face of the patient in the tube. At one or more preselected locations in panel 22*a* intersecting slits 74 are provided. Slits 74 permit a limb of the patient to be extended through panel 22*a*. This embodiment is particularly adapted for use by patients having a limb in a cast. The cast limb can be extended through the appropriate slit 74 and supported exteriorly of the cover enclosure. In this way the cast is protected from the water and there is no danger of the cast getting wet.

From the foregoing it will be seen that the present invention provides a novel and convenient patient bathtub which minimizes the patient movement necessary. The patient does not have to assume a sitting position or arise from his bed. Rather, the unit can be set-up and inflated in position about the patient. The bathtub can be conveniently stored when not in use and is portable. The bathtub of the present invention is designed to utilize a minimum of water and yet provide thorough washing of the patient.

It will be obvious to those skilled in the art to make various alterations, changes and modifications to the device of the present invention. To the extent that these changes, alterations and modifications do not depart from the spirit and scope of the appended claims, they are intended to be encompassed therein.

I claim:

1. A portable bathtub which can be pneumatically erected about a bed-ridden patient supported on the patient's bed, said bathtub comprising:

a. tub means including:

i. a floor of generally impervious material;

ii. generally tubular sidewalls secured to said floor and inflatable to define a generally longitudinal self-supporting enclosure to accommodate the patient, said floor and sidewalls in a deflated condition being portable and adapted to be supported on a bed surface along side a bed-ridden patient;

b. a cover extending from said sidewalls and across the enclosure to prevent water from splashing therefrom and to ensure patient privacy, said covering having fastening means associated therewith which can be selectively opened and closed to admit the patient into said enclosure; said enclosure defining an opening for at least the head of said patient;

c. a drain outlet attached to sid tub means connectable to a drain for selectively draining water from said enclosure; and d. water supply means including:

i. conduit means attachable to a water source and connected to tub means;

ii. spray means connected to said conduit means and secured to one of the said cover or said sidewall means within the enclosure oriented to deliver a spray of water on the enclosed patient whereby the bathtub can be located on the bed adjacent to the bed-ridden patient in a deflated condition and inflated to a self-supporting position of use about the patient and connected to a water supply to deliver a spray of water directed onto the body of the patient.

2. The bathtub of claim 1 further including recirculating means for recirculating water from within enclosure to said spray means.

3. The bathtub of claim 1 wherein said spray means includes at least one generally longitudinal spray pipe having a nozzle means therein for directing spray onto the patient.

4. The bathtub of claim 3 wherein said longitudinal spray pipe is carried on said cover means.

* * * * *